US007017836B1

(12) United States Patent
Lohkamp

(10) Patent No.: US 7,017,836 B1
(45) Date of Patent: Mar. 28, 2006

(54) ROTARY ATOMIZER COATING DISTRIBUTION APPARATUS

(75) Inventor: Mark R. Lohkamp, Billerica, MA (US)

(73) Assignee: Wilevco, Inc., Billerica, MA (US)

( * ) Notice: Subject to any disclaimer, the term of this patent is extended or adjusted under 35 U.S.C. 154(b) by 154 days.

(21) Appl. No.: 10/709,157

(22) Filed: Apr. 16, 2004

(51) Int. Cl.
*B05B 1/34* (2006.01)

(52) U.S. Cl. ..... 239/380; 239/383; 239/224; 239/222.13

(58) Field of Classification Search ..... 239/382, 239/224, 383, 282, 380, 283, 222.11, 222.13, 239/214.15, 7, 550, 555
See application file for complete search history.

(56) References Cited

U.S. PATENT DOCUMENTS 1,506,226 A * 8/1924 Dick ..... 239/224
3,017,116 A * 1/1962 Norris ..... 239/702
3,556,400 A * 1/1971 Gebhardt et al. ..... 239/702
4,978,069 A * 12/1990 Andersson et al. ..... 239/224
6,585,169 B1 * 7/2003 Andersson ..... 239/7
6,634,568 B1 * 10/2003 Andersson et al. ..... 239/7

* cited by examiner

*Primary Examiner*—David A. Scherbel
*Assistant Examiner*—Seth Barney
(74) *Attorney, Agent, or Firm*—Mark P. White

(57) ABSTRACT

A feed system for a rotary coating atomizer formed from two opposed coaxially mounted rotating atomizer assemblies consists of a cylindrical, hollow distributor mounted coaxially between the atomizer assemblies. The distributor contains one or more distributor feed holes formed in each opposing side in proximity to the adjacent atomizer assembly. A hollow axle passes coaxially through the distributor and the atomizer assemblies, and contains one or more axle feed holes beneath each distributor, so that when the coating is fed through the hollow axle it enters the distributor through the axle feed holes and exits the distributor through the distributor feed holes onto the atomizer assemblies.

15 Claims, 7 Drawing Sheets

ROTARY ATOMIZER COATING DISTRIBUTION APPARATUS

BACKGROUND OF INVENTION

The present invention is intended to be used with the atomizer described in Lohkamp, U.S. Pat. No. 6,550,693, issued on Apr. 22, 2003, and entitled "Coating apparatus and method of use", which is intended to coat food with a high-viscosity coating prior to further processing. The present invention is an apparatus for distributing the coating from a coating reservoir to the rotating atomizer disks of the prior invention.

Referring now to FIG. 1, the rotating disks 102, 104 of U.S. Pat. No. 6,550,693 are depicted, together with feed tube 180, used to convey coating to the hubs 130 which connect the rotating atomizer disks. This prior art system may be further understood by referring to FIG. 2, which shows the coating 120 projected outward by the centrifugal forces generated by the rotating disks.

As seen in FIG. 2, the feed tube 180 delivers the coating to the low point between the hubs 130, where is will climb the upward-sloping walls of the central hub, reaching the inner surfaces of the rotating disks before being broadcast outward.

This prior art patent describes some other variations of the above-described system.

The apparatus of the present invention replaces the coating distribution system described in the prior art in several ways. First, the present invention does not require separate feed tubes for each pair of rotating disks. And secondly, the present system distributes the coating from the inside of the central hubs, where it is transported directly to the inner surface of the rotating atomizer disks, thereby reducing coating waste resulting from coating broadcast from the outer hub surfaces in the prior art.

SUMMARY OF INVENTION

It is an object of the present invention to provide an atomizer for atomizing coating to be applied to a variety of foodstuffs prior to cooking.

It is a further object of this invention to provide such an atomizer which applies coating uniformly to the food, of a controlled depth, and with a minimum of waste.

It is a final object of this invention that the atomizer is of such a construction which contains a minimum number of parts, is reliable, easy and inexpensive to manufacture and maintain.

In accordance with one aspect of this invention, the apparatus includes two opposed, identical atomizer assemblies, each containing a disk-shaped atomizer plate having a cylindrical flange affixed at the perimeter of the plate, with the two atomizer assemblies coaxially aligned and disposed in proximity to each other, and made to rotate by means of a hollow distributor disposed coaxially between the atomizer assemblies and having one or more distributor feed holes formed in each opposing side of the distributor in proximity to the adjacent atomizer assembly.

In accordance with a second aspect of the invention, a multiplicity of opposed atomizer assemblies are included, each containing a disk-shaped atomizer plate having a cylindrical flange affixed at the perimeter of the plate, and each atomizer assembly having a common diameter, the atomizer assembly coaxially aligned and disposed so that each atomizer assembly is in proximity to one or more adjacent atomizer assemblies.

In accordance with a third aspect of the invention, a hollow distributor is disposed coaxially between each adjacent atomizer assembly, each distributor having one or more distributor feed holes formed in each opposing side of the distributor in proximity to the adjacent atomizer assembly.

In accordance with a fourth aspect of the invention, the apparatus includes a hollow axle passing coaxially through the distributor and the atomizer assemblies, the axle having one or more axle feed holes formed therein beneath the distributor.

In accordance with a fifth aspect of the invention the distributor is configured so that when the coating is fed through the hollow axle it enters the distributor through the axle feed holes and exits the distributor through the distributor feed holes onto the atomizer assemblies.

In accordance with a sixth aspect of the invention the atomizer assemblies, the hollow axle, and the distributors are constrained to rotate together.

In accordance with a seventh aspect of the invention the apparatus further includes a motor coupled to the hollow axle.

In accordance with an eighth aspect of the invention the apparatus further includes a sealed, fluid-tight means to allow the coating to pass from a stationary feed pipe into the rotating hollow axle.

In accordance with a ninth aspect of the invention each distributor is substantially cylindrical.

In accordance with a tenth aspect of the invention the apparatus further includes means to maintain each end of the distributor at a distance from the adjacent atomizer assembly.

In accordance with an eleventh aspect of the invention an annular lip affixed to each end of each distributor is used to maintain the distributor at a distance from the adjacent atomizer assembly.

In accordance with a twelfth aspect of the invention one or more collars are clamped to the hollow axle, and a plurality of pins are inserted into the distributor and the adjacent atomizer assemblies, and between each collar and each adjacent atomizer assembly, in order to make the hollow shaft, the distributors, and the atomizer assemblies rotate together.

BRIEF DESCRIPTION OF DRAWINGS

These, and further features of the invention, may be better understood with reference to the accompanying specification and drawings depicting the preferred embodiment, in which.

DETAILED DESCRIPTION

The current invention may be used in conjunction with the atomizer described in Lohkamp, U.S. Pat. No. 6,550,693, issued on Apr. 22, 2003, and entitled "Coating Apparatus and Method of Use". The disclosure of that patent is incorporated by reference into the present patent and forms a part hereof, for the purpose of helping the reader to understand the operation of the atomizer with and without the feed system of the present patent.

Figure 1:
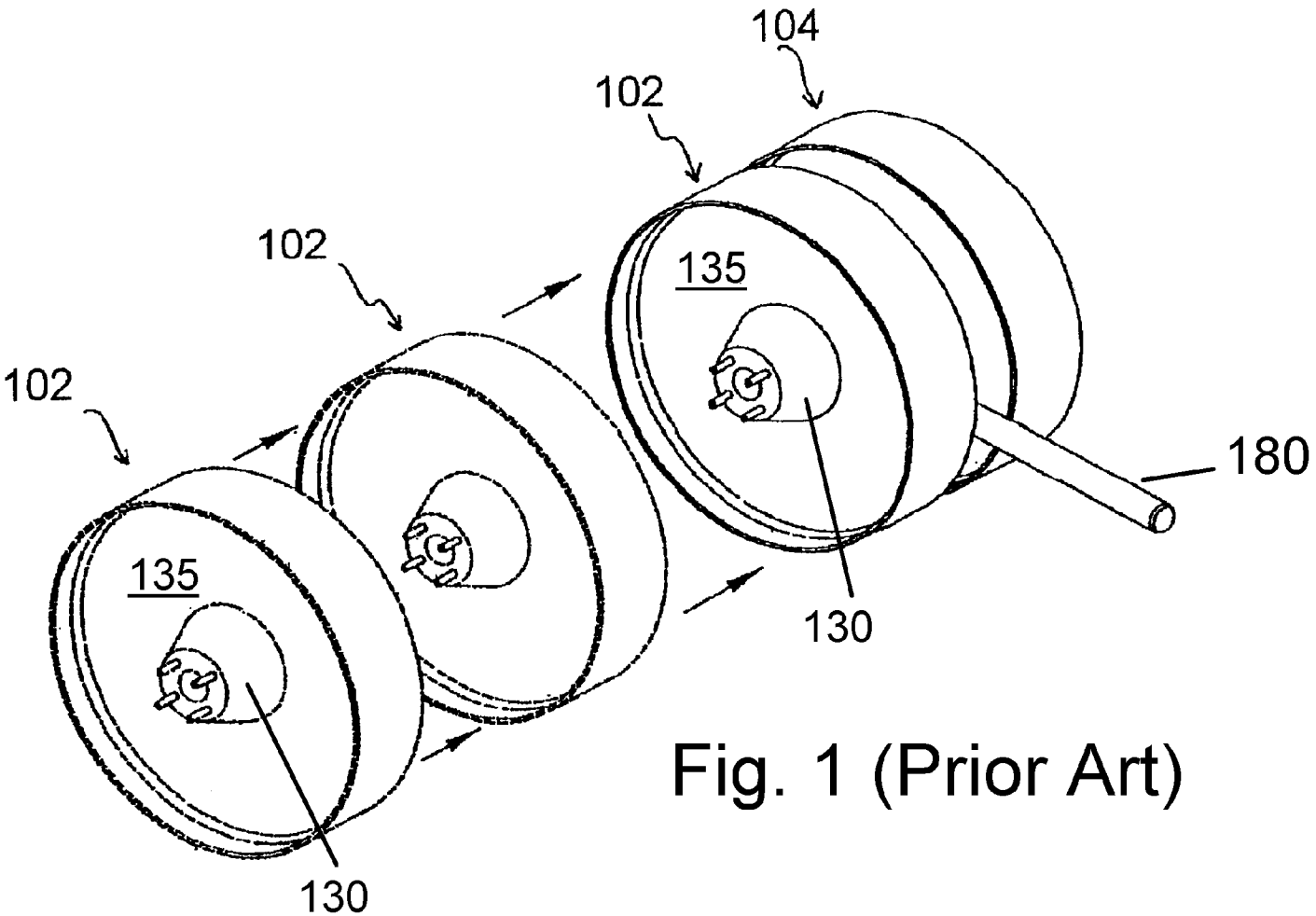
Fig. 1 (Prior Art)
FIG. 1 depicts a prior art array of rotating disk atomizer plates.
Figure 2:
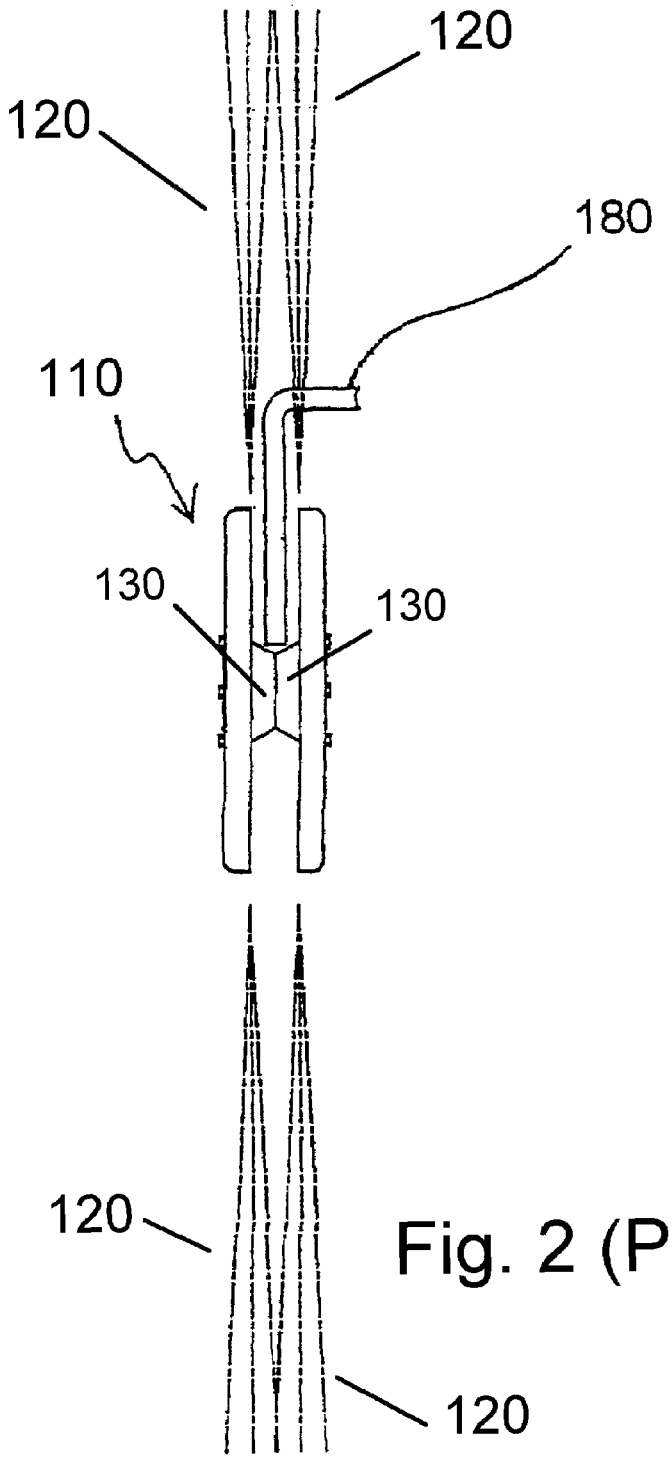
Fig. 2 (Prior Art)
FIG. 2 depicts a pair of prior art rotating disk atomizer plates with a coating feed tube disposed in proximity to the central hub, and with coating broadcast by the atomizer plates.

FIG. 1 depicts the prior art rotating plate atomizer concept, which incorporates pairs of concentric atomizer assemblies 110 separated by a central hub 130 concentrically mounted between the atomizer assemblies. In this prior art embodiment the coating to be atomized is fed through a feed tube 180 onto the hub. The coating then makes its way up the inner walls of the atomizer assemblies. The perspective view of FIG. 2 reveals the construction details of the individual atomizer assemblies. Each has an inner wall or surface 135 and a flange 102 which is affixed to the inner wall as shown. This Figure further shows the detail of the concentric hubs, which are pinned together to form the assembly of FIG. 1.

The present invention replaces the hubs 130 of the prior art with an improved distributor which is simple in construction, inexpensive to produce, and which provides a more efficient and reliable means of distributing the coating to the rotating atomizer than does the prior art.

Figure 4:
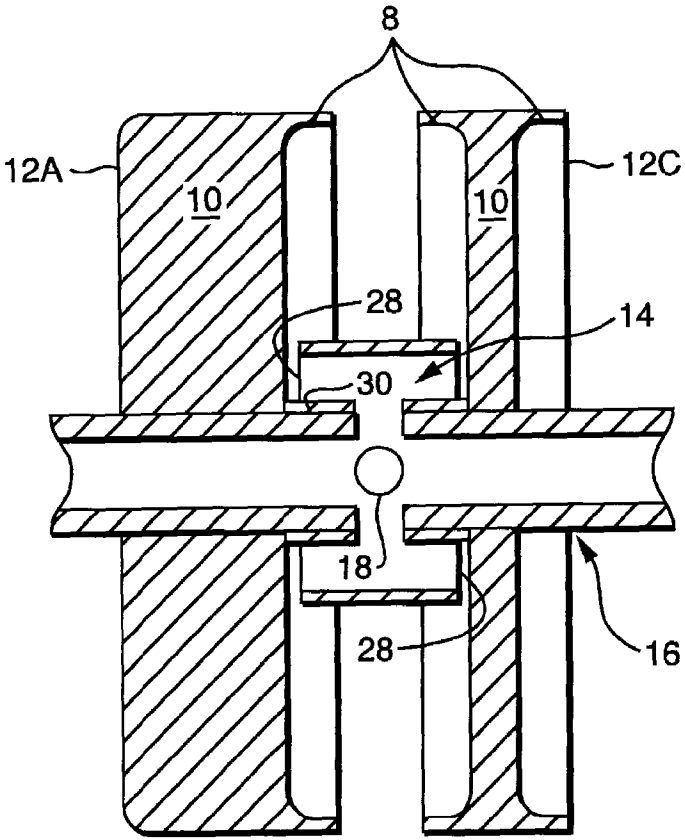
FIG. 4 depicts a cross-sectional view of a distributor disposed between two rotating atomizer plates, disclosing the hollow shaft concentrically connecting the plates and the distributor.
Figure 3:
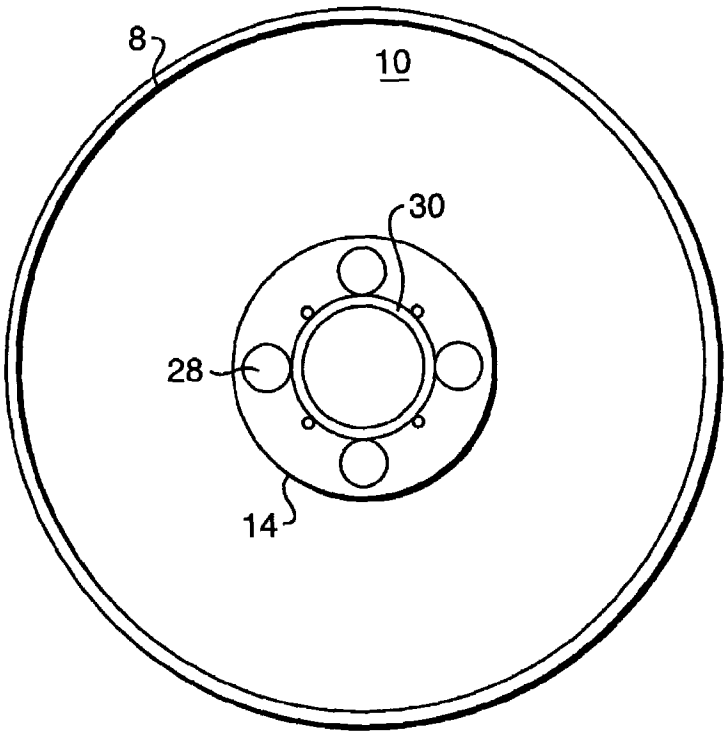
FIG. 3 depicts a side elevation view of a central distributor disposed at the center of a rotating atomizer plate.
Figure 5:
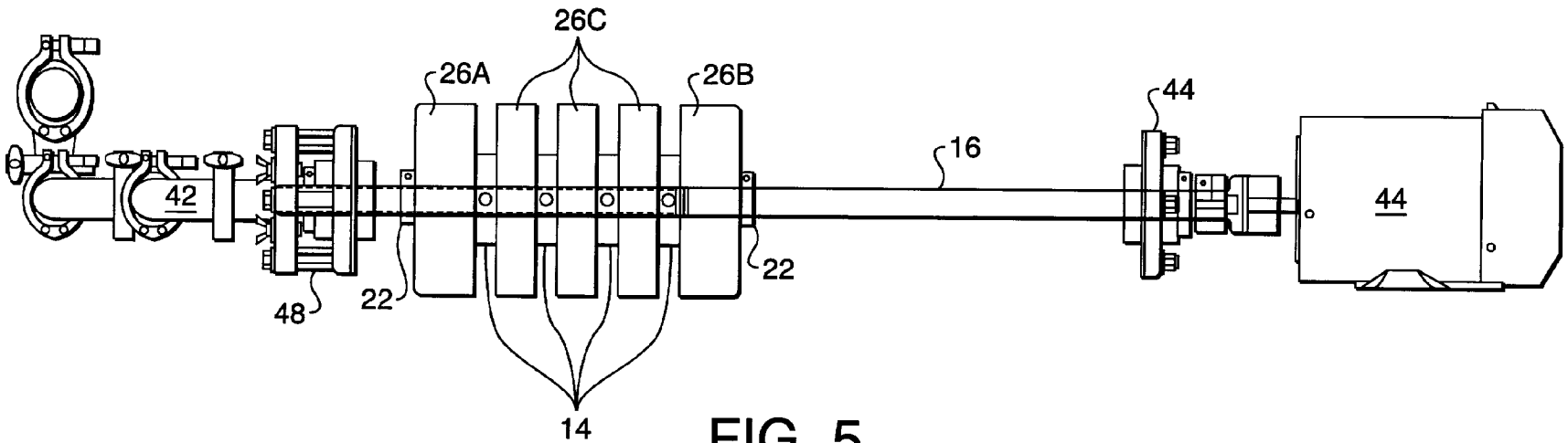
FIG. 5 depicts an elevation view of an array of rotating atomizer plates, each pair connected by a distributor, with a central hollow shaft concentrically connecting the array, driven by a motor at one end, and the hollow shaft attached to rotating coupling at the other end through which coating is fed to the apparatus.

In the present invention the coating to be atomized is distributed to all the rotating atomizer assemblies which are concentrically mounted in an array by means of a single, concentrically-mounted hollow axle or shaft 16, as may be seen by referring to FIG. 5 Referring next to FIGS. 3 and 4, the atomizer assemblies 12*a* and 12*c* are shown mounted on the hollow axle 16 on either side of the distributor 14. In FIG. 4 atomizer assembly 12A is a terminating, or end assembly, while atomizer assembly 12C is a dual atomizer assembly, in which coating is atomized and dispersed between inner plates 10 of assembly 12A and 12C, as well as between the inner plates of assembly 12C and another assembly to the right of this assembly not shown in FIG. 4. Also not shown, but required for operation in this figure is the distributor concentrically mounted to the right of assembly 12C. FIG. 5 reveals a five-assembly array with terminating assemblies 26A and 26B, and dual assemblies 26C disposed between the terminating assemblies. Distributors 14 are disposed between each pair of adjacent atomizer assemblies.

Figure 6:
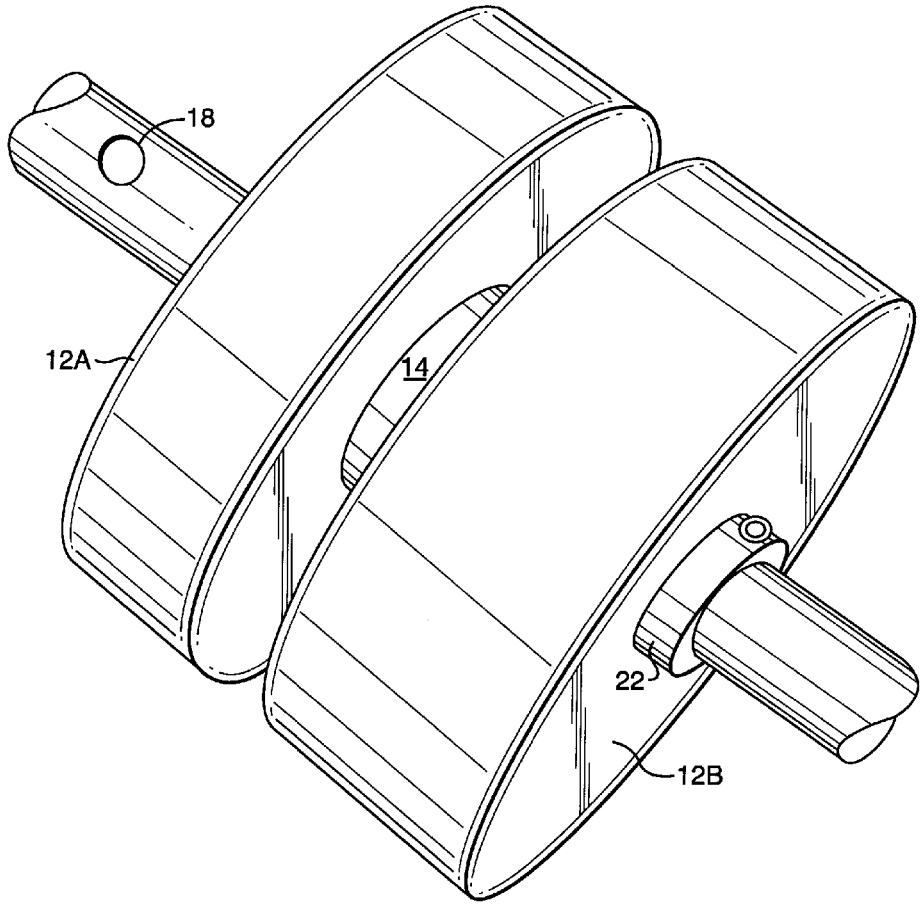
FIG. 6 depicts a perspective view of two rotating atomizer plates mounted concentrically on a hollow shaft, with a clamp collar restraining the atomizer plates on the shaft.

Referring now to FIGS. 4 and 6, the hollow axle contains axle feed holes 18 which allow the coating to be atomized to pass from the hollow axle into the interior of the distributor.

A collar 22, as shown in FIG. 5, is disposed at the end of the axle to retain the adjacent assembly 12*b* in place, and which is attached by pins 24 to the right-hand atomizer assembly.

Figure 8:
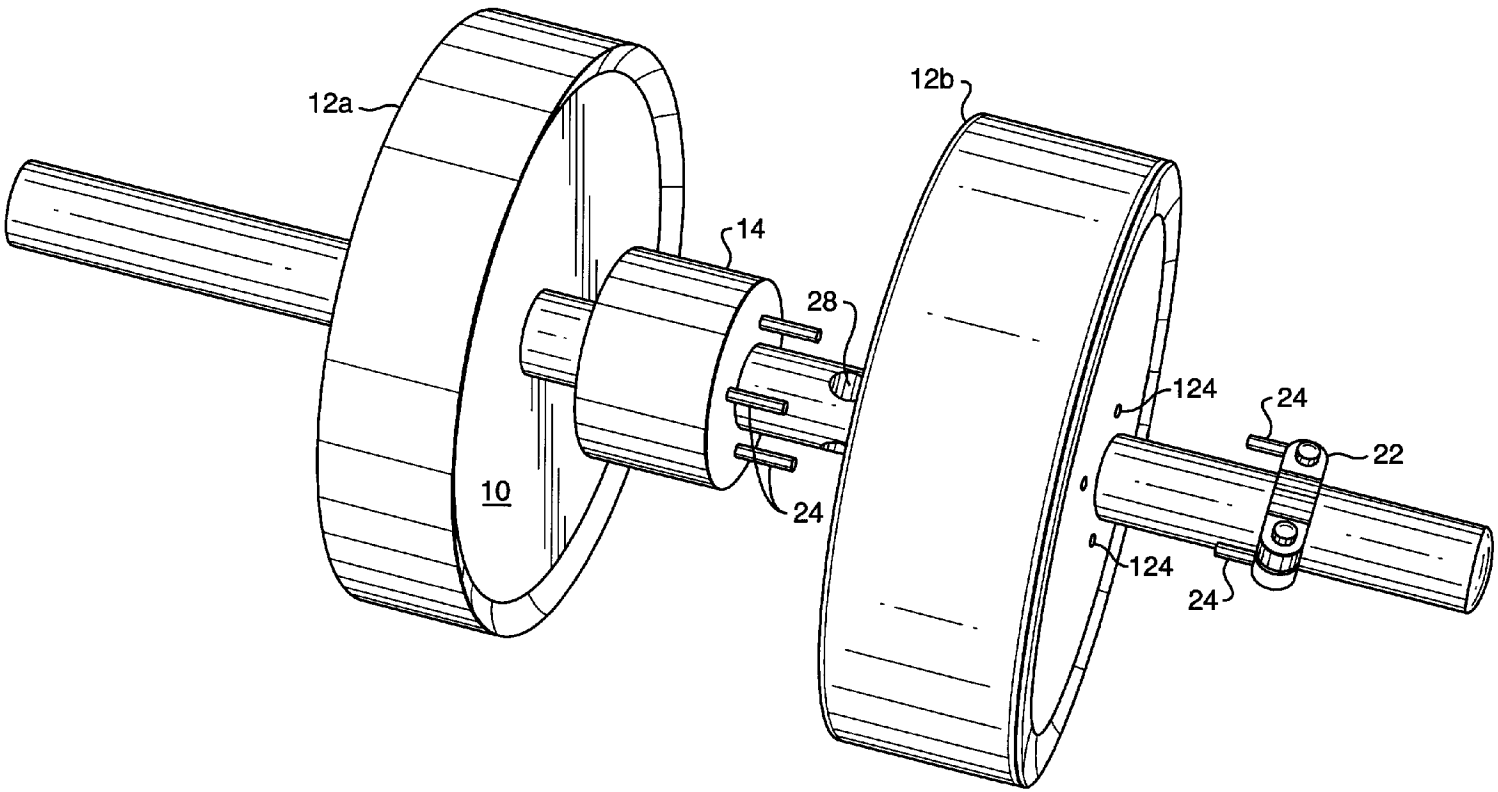
FIG. 8 shows a perspective depiction of a feed system in exploded view, having two atomizer assemblies, and with a distributor disposed between them.

FIG. 8 shows the components of the feed system in "exploded" view, to better disclose the component parts. When assembled for use, the collar 22 is pushed into contact with the right-hand atomizer assembly 12*b*, with the pins 24 fully inserted into mating holes in the right-hand atomizer plate, and the collar clamped onto the hollow axle so the right-hand atomizer plate is constrained to rotate with the axle. Further, the distributor 14 is pushed into contact with the right-hand atomizer assembly, with the pins 24 fully inserted into mating holes in the atomizer plate, so that the distributor is also constrained to rotate with the right-hand atomizer plate. Further, with the distributor in this position the feed holes 18 are aligned beneath the distributor so that the coating flows through the feed hole and into the distributor.

When the left-hand atomizer assembly is then pushed against the distributor, and affixed to rotate with the distributor, the axle, distributor, and both atomizer assemblies are constrained to rotate together. The right-hand atomizer plate is constrained by pins in the same way as the other components described above, with pins inserted into holes formed at the left side of the distributor and mating holes in the atomizer plate.

Figure 7:
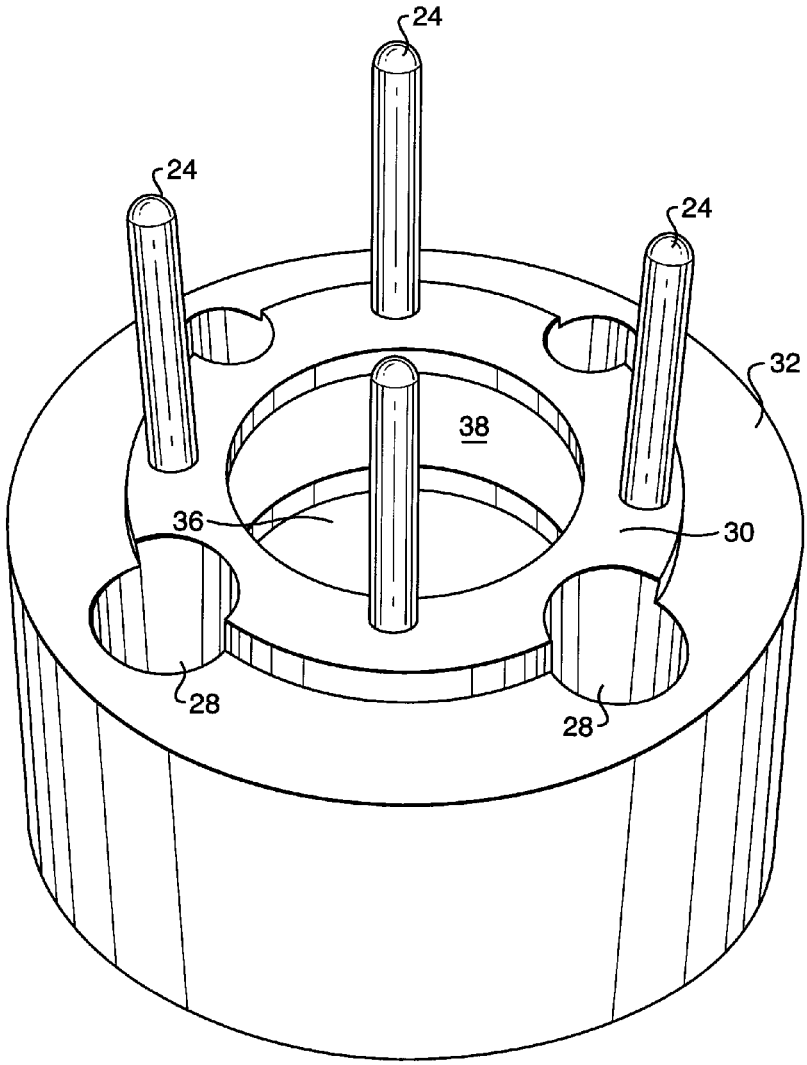
FIG. 7 is a perspective view of a distributor assembly, revealing attachment pins, the raised annular lip, attachment pins, and distributor feed holes.

Referring next to FIG. 7 a perspective view of the distributor itself is shown. The distributor is 2.75 inches in diameter and 1.73 inches in width in the preferred embodiment. An annular lip 30 projects an additional 0.13 inches from the side 32 in this preferred embodiment, so that when the distributor is forced against the side of the atomizer plate there will still be clearance between the distributor feed holes and the atomizer plate. This annular lip has an outer diameter of 2.00 inches in the preferred embodiment, with an inner diameter of 1.25 inches, which is the diameter of the central shaft hole 36 through which the hollow shaft passes. The hollow cavity within the distributor is visible within the central shaft hole in this view. The clearance created by the annular lip allows the coating to exit from the distributor and be distributed across the face of the atomizer plate as the plate rotates.

FIG. 7 reveals the feed holes 28 which allows the coating to exit from the distributor onto the atomizer plate. The pins 24 affix the distributor to the adjacent atomizer plate.

Referring again to FIGS. 3 and 4, the operation of the distributor may be fully understood.

The coating enters the distributor 14 central cavity through the feed hole 18 in the hollow axle 16. The coating exits through distributor feed holes 28, which are retained at a distance from the atomizer assemblies' inner surfaces 10 by means of the annular lip 30. In the process the coating changes directions, first moving at right angles from the axis of the hollow shaft to the feed holes which are at right angles to that axis. The coating stream again changes directions as it exits from the feed holes and moves to the distributor feed holes which are parallel to the hollow shaft.

The distributor is affixed to the atomizer plates by pins 24, so that they all rotate together with the shaft, which is pinned to the clamped-on collars on either side.

When the coating reaches the inner surfaces of the atomizer assemblies it rises toward the periphery of the atomizer assembly by centrifugal force, as described in U.S. Pat. No. 6,550,693. The coating reaches flange 8, disposed about the periphery of the atomizer assembly and attached to the plate 10, and is finally dispersed outwards in a mist made up of droplets of coating.

Referring again to FIG. 5, the operation of an array of atomizer assemblies may be understood. The coating is fed onto the stack through main feed pipe 42, which is stationary. Rotary coupling 48 provides a sealed, fluid-tight means to allows the coating to pass from the stationary feed pipe 42 into the rotating hollow axle 16. In the preferred embodiment a rotating joint using a lip seal is used in preference to a rotary union or coupling.

The entire array of atomizer assemblies 26A, 26B, and 26C rotates together with the hollow shaft 16, distributors 14, and collars 22, which are all pinned together so that they must move in unison. The arrays are driven by motor 44 through flexible coupling 44, which allows for a slight misalignment of the hollow shaft 16 and the motor.

The assembly provides an atomized spray radially outward between each adjacent set of atomizer assemblies in the array, similar to the pattern shown in the prior art atomizer of FIG. 1.

While the invention has been described with reference to specific embodiments, it will be apparent that improvements and modifications may be made within the purview of the invention without departing from the scope of the invention defined in the appended claims.

What is claimed is:

1. A feed system for a rotary coating atomizer which comprises two opposed, identical atomizer assemblies, each further comprising a disk-shaped atomizer plate having a cylindrical flange affixed at the perimeter of the plate, the two atomizer assemblies coaxially aligned and disposed in proximity to each other, the feed system comprising:

(a)a hollow distributor disposed coaxially between the atomizer assemblies and having one or more distributor feed holes formed in each opposing side of the distributor in proximity to the adjacent atomizer assembly; and (b)a hollow axle passing coaxially through the distributor and the atomizer assemblies, the axle having one or more axle feed holes formed therein beneath the distributor, so that when the coating is fed through the hollow axle it enters the distributor through the axle feed holes and exits the distributor through the distributor feed holes onto the atomizer assemblies.

2. A feed system for a rotary coating atomizer which comprises a multiplicity of opposed atomizer assemblies, each further comprising a disk-shaped atomizer plate having a cylindrical flange affixed at the perimeter of the plate, each atomizer assembly having a common diameter and coaxially aligned and disposed so that each atomizer assembly is in proximity to one or more adjacent atomizer assemblies, the feed system comprising:

(a)a hollow distributor disposed coaxially between each adjacent atomizer assembly, each distributor having one or more distributor feed holes formed in each opposing side of the distributor in proximity to the adjacent atomizer assembly; and (b)a hollow axle passing coaxially through all the distributors and the atomizer assemblies, the axle having one or more axle feed holes formed therein beneath each distributor, so that when the coating is fed through the hollow axle it enters the distributors through the axle feed holes and exits the distributors through the distributor feed holes onto the adjacent atomizer assemblies.

3. A rotary coating atomizer comprising (a)a multiplicity of opposed atomizer assemblies, each further comprising a disk-shaped atomizer plate having a cylindrical flange affixed at the perimeter of the plate, each atomizer assembly having a common diameter and coaxially aligned and disposed so that each atomizer assembly is in proximity to one or more adjacent atomizer assemblie, (b)a hollow distributor disposed coaxially between each adjacent atomizer assembly, each distributor having one or more distributor feed holes formed in each opposing side of the distributor in proximity to the adjacent atomizer assembly; and (c)a hollow axle passing coaxially through all the distributors and the atomizer assemblies, the axle having one or more axle feed holes formed therein beneath each distributor, so that when the coating is fed through the hollow axle it enters the distributors through the axle feed holes and exits the distributors through the distributor feed holes onto the adjacent atomizer assemblies.

4. The apparatus of claim 1, 2 or 3, wherein the atomizer assemblies, the hollow axle, and the distributors are constrained to rotate together.

5. The apparatus of claim 4, further comprising (a)a motor coupled to the hollow axle; and (b)a sealed, fluid-tight means to allow the coating to pass from a stationary feed pipe into the rotating hollow axle.

6. The apparatus of claim 5, wherein each distributor is substantially cylindrical, and further comprising means to maintain each end of the distributor at a distance from the adjacent atomizer assembly.

7. The apparatus of claim 6, wherein the means to maintain each end of the distributor at a distance from the adjacent atomizer assembly further comprises an annular lip affixed to each end of each distributor.

8. The apparatus of claim 7, wherein the means of constraining the atomizer assemblies, the hollow axle, and the distributors further comprises one or more collars clamped to the hollow axle, and a plurality of pins inserted into the distributor and the adjacent atomizer assemblies, and between each collar and each adjacent atomizer assembly.

9. A method for feeding a coating into an atomizer which comprises two opposed, identical atomizer assemblies, each further comprising a disk-shaped atomizer plate having a cylindrical flange affixed at the perimeter of the plate, the two atomizer assemblies coaxially aligned and disposed in proximity to each other, the method comprising:

(a)disposing a hollow distributor coaxially between the atomizer assemblies, the distributor having one or more distributor feed holes formed in each opposing side of the distributor in proximity to the adjacent atomizer assembly; and (b)disposing a hollow axle to pass coaxially through the distributor and the atomizer assemblies, the axle having one or more axle feed holes formed therein beneath the distributor, so that when the coating is fed through the hollow axle it enters the distributor through the axle feed holes and exits the distributor through the distributor feed holes onto the atomizer assemblies.

10. A method for feeding coating into a rotary atomizer which comprises a multiplicity of opposed atomizer assemblies, each further comprising a disk-shaped atomizer plate having a cylindrical flange affixed at the perimeter of the plate, each atomizer assembly having a common diameter and coaxially aligned and disposed so that each atomizer assembly is in proximity to one or more adjacent atomizer assemblies, the method comprising:

(a)disposing a hollow distributor coaxially between each adjacent atomizer assembly, each distributor having one or more distributor feed holes formed in each opposing side of the distributor in proximity to the adjacent atomizer assembly; and (b)disposing a hollow axle to pass coaxially through all the distributors and all the atomizer assemblies, the axle having one or more axle feed holes formed therein beneath each distributor, so that when the coating is fed through the hollow axle it enters the distributors through the axle feed holes and exits the distributors through the distributor feed holes onto the adjacent atomizer assemblies.

11. The method of claim 9 or 10, wherein the atomizer assemblies, the hollow axle, and the distributors are constrained to rotate together.

12. The method of claim 11, further comprising (a)disposing a motor coupled to the hollow axle;

(b)disposing a sealed, fluid-tight means to allow the coating to pass from a stationary feed pipe into the rotating hollow axle.

13. The method of claim 12, wherein each distributor is substantially cylindrical, and further comprising maintaining each end of the distributor at a distance from the adjacent atomizer assembly.

14. The method of claim 13, further comprising affixing an annular lip to each end of each distributor to maintain each end of each distributor at a distance from the adjacent atomizer assembly.

15. The method of claim 14, further comprising clamping one or more collars onto the hollow axle, each in proximity to an atomizer assembly, and inserting a plurality of pins into each collar and into the adjacent atomizer assembly, and inserting a plurality of pins into each distributor and to the adjacent atomizer assembly.

* * * * *